US005830238A

United States Patent [19]

Maldonado-Millan et al.

[11] Patent Number: 5,830,238

[45] Date of Patent: Nov. 3, 1998

[54] PROCESS FOR IMPROVING THE SURFACE YIELD IN THE FABRICATION OF TANNED HIDES

[76] Inventors: Fernando Maldonado-Millan, Bahia Pinos 2F-1E, Alicante, Spain; Alfredo Garcia-Espantaleon Navas, 12005 Castellon, Godofredo Buenoaires, 11, 6 Å A, Spain; Juan Salmeron Egea, 46022 Valencia, Avda. Blasco Ibañez, 145 Puerta 15, Spain

[21] Appl. No.: 765,103

[22] PCT Filed: Jan. 31, 1996

[86] PCT No.: PCT/ES96/00017

§ 371 Date: Apr. 2, 1997

§ 102(e) Date: Apr. 2, 1997

[87] PCT Pub. No.: WO96/33289

PCT Pub. Date: Oct. 24, 1996

[51] Int. Cl.[6] ..... C14B 1/26

[52] U.S. Cl. ..... 8/94.2; 69/21

[58] Field of Search ..... 8/94.2, 94.18; 69/21

[56] References Cited

FOREIGN PATENT DOCUMENTS 1138835 1/1969 United Kingdom .

1429480 3/1976 United Kingdom .

OTHER PUBLICATIONS

Thorstensen, Practical Leather Technology, pp. 248–251, 1976.

The Oxford English Dictionary, Second Edition, vol. XX, pp. 170–176. (Month Unknown), 1989.

Thorstensen, "Practical Leather Technology." 1976, pp. 214–215.

*Primary Examiner*—Alan Diamond

[57] ABSTRACT

Procedure to improve the area yield in the manufacture of leather consisting of a thermal treatment applied to the extended or stretched leather, before the operation of drying. During this treatment there should be no loss in the water content of the leather. The applicattion of this procedure in the manufacture of leather allows improvements to be obtained in the area yield of about ten percent and, when applied to dyed leathers, an improvement is obtained in the fixation of the products used in the wet phases and, therefore, an improvement in the fastness properties to rubbing at dry as well as wet conditions. The application of this procedure reduces the modulus of the leather for which its use can be especially interesting for leather destined for clothing, upholstery, and some types of footwear which require lower elasticity values.

6 Claims, No Drawings

PROCESS FOR IMPROVING THE SURFACE YIELD IN THE FABRICATION OF TANNED HIDES

This application is a 371 of PCT/ES96/00017 filed Jan. 1, 1996.

The present Invention refers to a process for increasing the area yield and adaption of the elasticity modulus in the manufacture of leather, applicable after the tanning, dyeing or fatliquoring process, and before the drying operation.

In the manufacture of leather, raw material, hides and skins, are mainly bougth by weight while the finished product is generally sold by area. Thus, any process which manages to increase the area yield in conventional manufacturing is of great economic interest.

Practically all the operations in the manufacture of leather can have a positive or negative effect on the area yield of the finished product. In the drying process, for example, by previously treating the skin in a vacuum dryer or stretching it on a plate, a better area yield will be achieved than by drying it in the open air, although, with this process some characteristics can be obtained which are otherwise difficult to obtain by other methods.

The treatments used, in the stretching system, aims, in addition to gaining area, to achieve certain organoleptic characteristics. The improvement in area is apparent, then gradually disappears during the later finishing processes, especially when the leather is re-dampened and dried again. Likewise, this improvement partially or completely disappears during storing of the finished product.

The procedure of the present invention consists of a thermal treatment on damp leather previously spread or stretched, with the special feature that during the said treatment no significant loss in the leather's water content is produced.

After tanning, dyeing or fatliquoring and before the drying process, the leather is spread and/or stretched by one of the known methods, for example on perforated frames with manual or automatic stretching on similar plates to those used in "pasting" drying, etc., or simply placed between boards or laminates which keep it extended.

Whatever the case, the tension to apply will mainly depend on the type of leather and its final use; for example, for grain leather, linear stretching will be between 5% and 25%, and for suedes, splits and leathers which require low elasticity, the enlargements may be greater.

The leathers prepared in this way undergo a thermal treatment in an open or closed container, with the possible addition of water or water vapour, in order to maintain the leather's water content and the temperature of the leather/water/air throughout the treatment.

The temperature applied for the thermal treatment will depend on the characteristics of the leather and its final use, but it will be between 40 and 100 degrees centigrade, preferably between 50 and 90 degrees centigrade, for a period of between 2 minutes and several hours, preferably between 10 and 30 minutes.

If after this treatment, object of the present invention, the leather proceeds to the drying process, this may be done by any of the conventional methods, even on the stretched leather, although it is preferable to reduce the tension applied before proceeding to a conventional drying method.

Being a specific procedure for increasing the area yield of the leather, the verification of its efficiency is relatively simple, it is enough to apply it to whatever conventional leather manufacturing system, without modifying the rest of the process at all, comparing the area yield results.

The improvement in the area yield obtained by this treatment, object of the present invention, is between 5 and 15% for conventional processes for leathers in which the grain elasticity must be controlled. The values mentioned may be greater in the case of suede leathers and splits, and in cases when leathers with reduced elasticity are required, to be used, for example, in clothing, upholstery and some types of footwear.

As a result of the thermal treatment applied, the fixation of the different products is also improved, as is the application of dyestuffs and fats substances used in the elaboration of leather, which can be seen as a general improvement of the fastness characteristics of the finished leather.

From the conceptual point of view, the treatment, object of this Invention, cannot under any circumstances form a part of the so-called drying process, as it is very important that no water is lost during this treatment. By acting in this way the production regularity is controlled and, above all, greater efficiency and security is achieved in the improvement of the area yield.

For this Patent, the process, object of the present invention, is considered to be separate from the drying operation, but this does not mean that in practice it remains included within it, although in reality it is a previous process.

The invention procedure is applicable to leathers, limed or not, from all animal species, mainly ovine, caprine, or bovine.

To facilitate understanding of the ideas presented, the following describes an example of the execution of this procedure. Given its purely illustrative character, this example will have to be considered as lacking all limitative reach concerning the legal protection that it requests.

Take 24 bovine sides shaved to 1,8 mm which have been subjected to a conventional tanning, dyeing and fatliquoring process, and separate them into two groups A and B with 12 sides in each, so that the total weight of each group is the same.

Subject group A to a conventional drying process in vacuum and hunging in air at room temperature.

Toggle the leathers in group B to suitable frames with a linear stretching of 10% and submerge them in water at 85 degrees centigrade for 15 minutes. After this thermal treatment, remove the frames from the water, leave the leather to cool down for several minutes and release them from the toggles. Next, subject them to a conventional drying process in vacuum and hunging in air, in the same way as the leathers in group A.

Subject both groups of leather A and B to a conventional conditioning and staking process, leave to rest piled for 48 hours, and carry out the measurement of the area of each of the leather sides. It follows that the total area of group B is greater than the total area of group A by 9.3%.

Now that the characteristics of the invention have been described, it must be noted that within this there can be many variants of detail, learned by experience, without however, altering the fundamental nature summed up in the following claims.

We claim:

1. A process for increasing the area yield in the manufacture of leather which comprises applying a thermal treatment, at a temperature between 40 and 100 degrees centigrade, to wet tanned leather which is either submerged in water or in an atmosphere which is saturated with water vapor, and which is extended under pressure and/or stretched in all directions, wherein said treatment takes between 2 minutes and 3 hours and is done before conventional drying of the leather.

2. The process of claim 1, wherein the water content of the leather is kept constant during the treatment, as well as the temperature.

3. The process of claim 1, wherein the wet leather is extended under pressure and/or stretched in all directions with a linear enlargement of 5 to 30%.

4. The process of claim 1, where the treatment takes between 10 and 30 minutes.

5. The process of claim 1 wherein the wet tanned leather is submerged in water.

6. The process of claim 1 wherein the wet tanned leather is in an atmosphere which is saturated with water vapor.

* * * * *